US008689728B2

(12) United States Patent
Adolfo et al.

(10) Patent No.: US 8,689,728 B2
(45) Date of Patent: Apr. 8, 2014

(54) APPARATUS FOR HOLDING A MEDICAL DEVICE DURING COATING

(76) Inventors: Menendez Adolfo, Woodbury, MN (US); Paul W Schmokel, Prior Lake, MN (US); Eilaz P Babaev, Minnetonka, MN (US); Scott R Banaszewski, Circle Pines, MN (US); Michael R Afremov, Hopkins, MN (US)

( * ) Notice: Subject to any disclaimer, the term of this patent is extended or adjusted under 35 U.S.C. 154(b) by 1571 days.

(21) Appl. No.: 11/867,818

(22) Filed: Oct. 5, 2007

(65) Prior Publication Data

US 2009/0090299 A1 Apr. 9, 2009

(51) Int. Cl.
*B05C 13/00* (2006.01)
*B05D 3/00* (2006.01)

(52) U.S. Cl.
USPC ..... 118/500; 427/2.24

(58) Field of Classification Search
USPC ..... 118/408
See application file for complete search history.

(56) References Cited

U.S. PATENT DOCUMENTS

| | | | | |
|---|---|---|---|---|
| 2,734,000 | A * | 2/1956 | Pessel | 427/120 |
| 3,970,250 | A | 7/1976 | Drews | |
| 4,402,458 | A | 9/1983 | Lierke et al. | |
| 4,511,624 | A * | 4/1985 | Kawaguchi et al. | 428/379 |
| 4,684,328 | A | 8/1987 | Murphy | |
| 4,715,353 | A | 12/1987 | Koike et al. | |
| 4,850,534 | A | 7/1989 | Takahashi et al. | |
| 5,336,534 | A | 8/1994 | Nakajima et al. | |
| 5,597,292 | A | 1/1997 | Rhee et al. | |
| 6,010,573 | A * | 1/2000 | Bowlin | 118/620 |
| 6,102,298 | A | 8/2000 | Bush | |
| 6,113,621 | A * | 9/2000 | Wiktor | 606/195 |
| 6,214,115 | B1 | 4/2001 | Taylor et al. | |
| 6,234,765 | B1 | 5/2001 | Deak | |
| 6,478,754 | B1 | 11/2002 | Babaev | |
| 6,527,863 | B1 * | 3/2003 | Pacetti et al. | 118/500 |
| 6,663,765 | B2 | 12/2003 | Cherkes | |
| 6,695,920 | B1 | 2/2004 | Pacetti et al. | |
| 6,720,710 | B1 | 4/2004 | Wenzel et al. | |
| 6,723,373 | B1 | 4/2004 | Narayanan et al. | |
| 6,726,829 | B2 | 4/2004 | Trozera | |
| 6,730,349 | B2 | 5/2004 | Schwarz | |

(Continued)

FOREIGN PATENT DOCUMENTS

| | | |
|---|---|---|
| WO | WO2004008995 A2 | 1/2004 |
| WO | WO2005034805 A1 | 4/2005 |

(Continued)

OTHER PUBLICATIONS

Berger, Harvey L., Coating Drug-eluting Arterial Stents Using Ultrasonic Spray Nozzles, article, May 2006, Sono-Tek Corporation, Milton, NY.

*Primary Examiner* — Dah-Wei Yuan
*Assistant Examiner* — Charles Capozzi

(57) ABSTRACT

The present invention is directed towards the holding of medical devices during manufacture to enable the application of therapeutic and/or protective coatings. More specifically, the present invention provides medical device holders that securely retain stents and other medical devices during the application of a coating while minimizing compressive and tensile forces applied to the stents. The invention avoids disruptions to coating quality due to holder blockage during coating deposition. The invention discloses an improved device containing a mandrel and frame that may improve coating uniformity by eliminating shadowing from the frame of the medical device holder when applying coatings to stents and other medical devices.

10 Claims, 7 Drawing Sheets

(56) References Cited

U.S. PATENT DOCUMENTS

| | | | | |
|---|---|---|---|---|
| 6,821,549 | B2 * | 11/2004 | Jayaraman | 427/2.24 |
| 6,837,445 | B1 | 1/2005 | Tsai | |
| 6,883,729 | B2 | 4/2005 | Putvinski et al. | |
| 6,955,723 | B2 | 10/2005 | Pacetti et al. | |
| 7,000,305 | B2 | 2/2006 | Jayaraman | |
| 7,004,967 | B2 | 2/2006 | Chouinard et al. | |
| 7,060,319 | B2 | 6/2006 | Fredrickson | |
| 7,166,124 | B2 | 1/2007 | Xie et al. | |
| 7,198,675 | B2 | 4/2007 | Fox et al. | |
| 7,201,940 | B1 | 4/2007 | Kramer | |
| 7,208,070 | B2 | 4/2007 | Swain | |
| 7,258,891 | B2 | 8/2007 | Pacetti et al. | |
| 2002/0127346 | A1 | 9/2002 | Heber | |
| 2003/0098364 | A1 | 5/2003 | Jameson | |
| 2003/0223886 | A1 | 12/2003 | Keilman | |
| 2004/0013792 | A1 * | 1/2004 | Epstein et al. | 427/2.24 |
| 2004/0039375 | A1 | 2/2004 | Miyazawa | |
| 2004/0045547 | A1 | 3/2004 | Yamamoto et al. | |
| 2004/0062853 | A1 | 4/2004 | Pacetti et al. | |
| 2004/0133270 | A1 | 7/2004 | Grandt | |
| 2004/0204680 | A1 | 10/2004 | Lal et al. | |
| 2005/0064088 | A1 | 3/2005 | Fredrickson | |
| 2005/0069630 | A1 | 3/2005 | Fox et al. | |
| 2005/0096733 | A1 | 5/2005 | Kovneristy et al. | |
| 2005/0202156 | A1 | 9/2005 | O'Connor et al. | |
| 2005/0224473 | A1 | 10/2005 | Merdan et al. | |
| 2005/0238829 | A1 * | 10/2005 | Motherwell et al. | 428/34.1 |
| 2006/0147611 | A1 * | 7/2006 | Coye et al. | 427/2.1 |
| 2006/0165872 | A1 * | 7/2006 | Chappa et al. | 427/2.24 |
| 2006/0200231 | A1 | 9/2006 | O'Brien et al. | |
| 2006/0210702 | A1 | 9/2006 | Van Sciver et al. | |
| 2007/0003688 | A1 * | 1/2007 | Chen et al. | 427/2.24 |
| 2007/0031611 | A1 | 2/2007 | Babaev | |
| 2007/0051307 | A1 | 3/2007 | Babaev | |
| 2007/0116855 | A1 | 5/2007 | Fox et al. | |
| 2007/0131165 | A1 | 6/2007 | Fox et al. | |
| 2007/0135897 | A1 * | 6/2007 | Chen et al. | 623/1.16 |
| 2007/0163668 | A1 | 7/2007 | Arbefeuille et al. | |
| 2007/0295832 | A1 | 12/2007 | Gibson et al. | |
| 2008/0006714 | A1 | 1/2008 | McNichols et al. | |
| 2008/0067728 | A1 * | 3/2008 | Plans et al. | 269/47 |

FOREIGN PATENT DOCUMENTS

| | | | |
|---|---|---|---|
| WO | WO2005112570 | A3 | 12/2005 |
| WO | WO2007021427 | A2 | 2/2007 |
| WO | WO2007031611 | A1 | 2/2007 |

* cited by examiner

APPARATUS FOR HOLDING A MEDICAL DEVICE DURING COATING

BACKGROUND OF THE INVENTION

1. Field of the Invention

The present invention generally regards the holding of medical devices during manufacture to enable the application of therapeutic and/or protective coatings. More specifically, the present invention provides medical device holders that securely retain medical devices during the application of a coating while minimizing compressive and tensile forces applied to the medical devices and disruptions to the coating due to holder blockage of coating deposition. The invention discloses an improved device that may improve coating uniformity by reducing shadowing from the frame of the medical device holder when applying coatings to medical devices.

2. Background

A wide variety of medical devices have been developed as medical implants and are used for innumerable medical purposes, including the reinforcement of recently re-enlarged lumens, the replacement of ruptured vessels, and the treatment of disease such as vascular disease by local pharmacotherapy, i.e., delivering therapeutic drug doses to target tissues while minimizing systemic side effects. Such localized delivery of therapeutic agents has been proposed or achieved using medical implants which both support a lumen within a patient's body and place appropriate coatings containing therapeutic agents at the implant location.

The term "medical device" as used in this application includes stents, catheters, synthetic veins and arteries, artificial valves or other similar devices with a hollow or open center portion amenable to coating on the holder. For clarity, understandability and by way of example, the term "stent" in this application is used interchangeably with the term "medical device". The delivery of expandable stents is a specific example of a medical procedure that involves the deployment of coated implants. Expandable stents are tube-like medical devices, typically made from stainless steel, tantalum, platinum or nitinol alloys, designed to be placed within the inner walls of a lumen within the body of a patient. These stents are typically maneuvered to a desired location within a lumen of the patient's body and then expanded to provide internal support for the lumen. The stents may be self-expanding or, alternatively, may require external forces to expand them, such as by inflating a balloon attached to the distal end of the stent delivery catheter.

Because of the direct contact of the stent with the inner walls of the lumen, stents have been coated with various compounds and therapeutic agents to enhance their effectiveness. These coatings may, among other things, be designed to facilitate the acceptance of the stent into its applied surroundings. Such coatings may also be designed to facilitate the delivery of one of the foregoing therapeutic agents to the target site for treating, preventing, or otherwise affecting the course of a disease or tissue or organ dysfunction.

The mechanical process of applying a coating onto a stent may be accomplished in a variety of ways, including, for example, the spraying of the coating substance onto the stent. While applying the coating to the stent, there is a need to contact the stent with the spray to ensure an even, intact, robust coating of the desired thickness on the stent.

SUMMARY OF THE INVENTION

The present invention is directed to an apparatus for overcoming the foregoing disadvantages. Specifically, there is provided a stent holder comprising a frame and a mandrel. The frame is fixed, with the mandrel free to rotate within the frame. The mandrel is provided with a stent support preferably consisting of a wire loop passing through the center of a stent. The stent support is held at both ends by support retainers such as a hook, clasp and/or clamp. The support retainers spread the wire loop apart such that the loop contacts the inside edge of its respective end of the stent at each end. The stent holders simultaneously maintain sufficient tension on the wire loop to generate a relatively light force on the stent to positively locate it between the holders. Due to the light force and the location of the cross wire within the stent, the stent holder does not apply damaging forces to the stent, and minimizes the creation of spray shadows. Moreover, due to the interchangeability of various wire loops, the stent holders can easily and inexpensively accommodate a range of stent lengths and diameters.

The mandrel, supported by bearing surfaces on the frame, rotates within the frame exposing the stent to the spray pattern. A uniform coating may be deposited on the stent since the spray has an unobstructed path to the rotating stent. The mandrel rotation is provided by a directly coupled motor or other drive source.

Where the stent has been coated, care must be taken during its manufacture and delivery within the patient to ensure the coating is evenly applied and firmly adherent to the stent, and further that the coating is not damaged or completely removed from the implant during the deployment process. When the amount of coating is depleted the implant's effectiveness may be compromised and additional risks may be inured into the procedure. For example, when the coating of the implant includes a therapeutic agent, if some of the coating were removed during deployment, the therapeutic may no longer be able to be administered to the target site in a uniform and homogenous manner. Thus, some areas of the target site may receive high quantities of therapeutic while others may receive low quantities of therapeutic. In certain circumstances, the removal and reinsertion of the stent through a second medical procedure may be required where the coatings have been damaged or are defective.

Stent holders as described in the prior art typically have a solid mandrel wherein the stent is supported by at least one end. In one embodiment, Narayanan, U.S. Pat. No. 6,723,373, a stent is slid entirely over a solid mandrel. This results in extensive contact between the interior of the stent and the mandrel, resulting in poor coating of the stent interior. In another embodiment, a mandrel supporting a stent by one end, the stent must be sprayed, flipped end for end, and then resprayed. This results in an inefficient spray process, and may result in coating non-uniformity do to spray overlap near the center of stent. In another embodiment, Epstein patent application Ser. No. 10/198,094 describes a stent holder using a wire mounted on a frame. The wire feature minimizes direct contact between the holder and the interior of the stent, however, rotating the stent according to the disclosed invention, requires rotating the frame holding the stent. Shadowing, the incomplete coating spray application onto the stent due to structural elements of the stent holder blocking the spray, occurs as the frame rotates since it cuts across the coating spray path creating a shadow on the stent as a result of the interference of the holder on the spray pattern of the coating.

Shadowing resulting in non-uniform coating application is one problem with prior art devices. In addition, if the stent is held too loosely, it may either shift during the coating process or it may become prematurely separated from the holder, resulting in an inconsistent or damaged coating. Difficulties with properly aligning the stent on this device, high centripetal forces generated during spinning, and low retention forces on the stent can result in premature separation of the stent from the holder. Further, prior art devices are not easily interchangeable across a range of stent sizes, and often must be custom built for each specific stent size. Further disadvantages of the prior art stent holders are the relatively high expense given their complexity and the need to use high strength materials The present invention discloses a relatively inexpensive, robust flexible stent holder which eliminates shadowing from the holder and can positively hold, locate and retain a stent during stent coating processes such as spray coating, while not mechanically shadowing the stent or otherwise interfering with the application of the coating.

DETAILED DESCRIPTION

Figure 1:
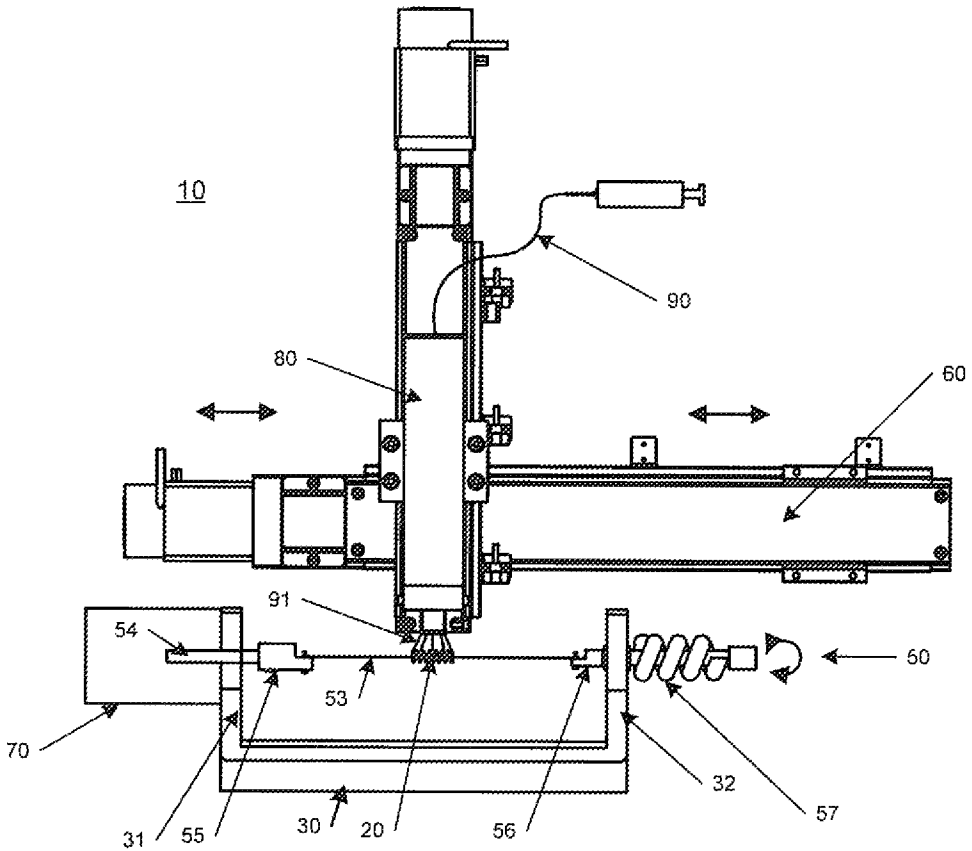
FIG. 1 is an illustration of the stent holding apparatus as used for stent coating.

The present invention is directed to an apparatus for overcoming the foregoing disadvantages. The term "medical device" as used in this application includes stents, catheters, synthetic veins and arteries, artificial valves or other similar devices with a hollow or open center portion amenable to coating on the holder. For clarity, understandability and by way of example, the term "stent" in this application is used interchangeably with the term "medical device". The stent holder 10 may be used for a heating, coating or other processes useful with stent manufacturing. For illustrative purposes, a coating apparatus is shown in FIG. 1. It is understood that the stent holder 10 may also be used for other stent manufacturing processes. As shown in FIG. 1 a coating feed 90 is supplied to a spray gun 80 from where it is discharged as a coating spray 91 on to a stent 20. The spray gun 80 is preferably an ultrasonic spray gun, but alternative embodiments such as a pressure spray may also be suitable. The spray gun 80 is positionable along the length of the stent 20 using a linear motor 60 which directs the coating spray 91 to different portions of the stent 20 in a precisely controlled and reproducible manner. A wide variety of options are known in the prior art as to the active coating ingredients, carrier fluids and spray patterns.

Figure 2:
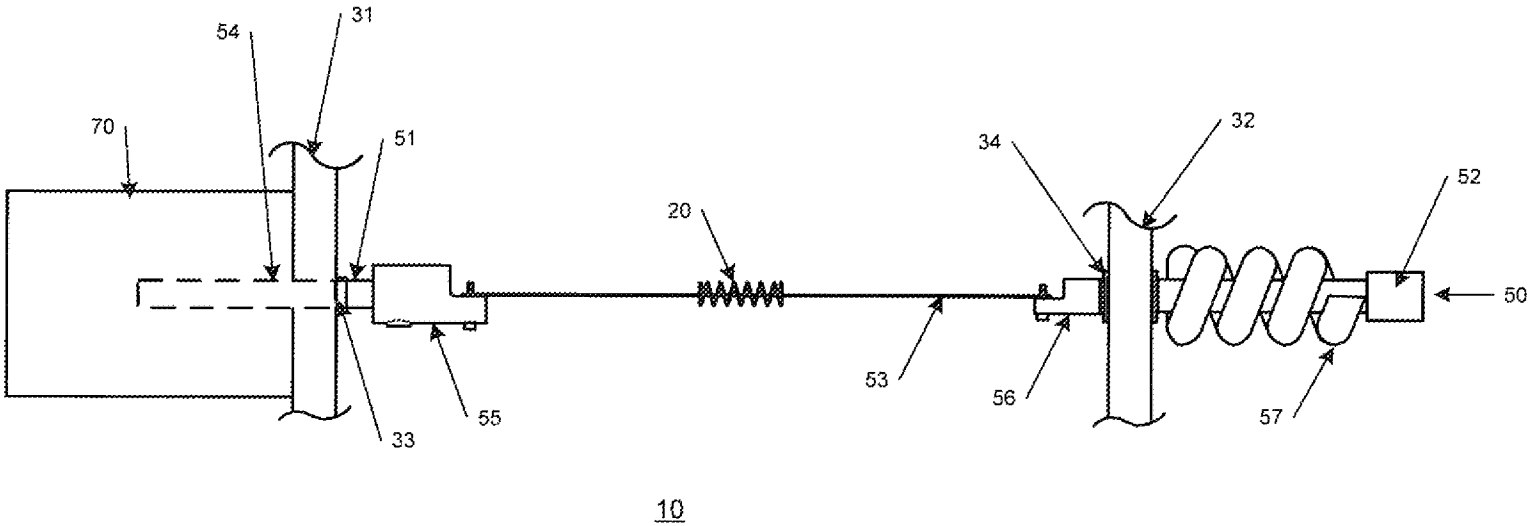
FIG. 2 is an elevational view of the mandrel portion of the stent holding apparatus.

A stent holder 10 in FIG. 1 comprises a frame 30 and a mandrel 50 supporting the stent 20. As shown in FIG. 2, the mandrel 50 consists of at least a stent support 53, drive portion 54, first shaft 51, a first support retainer 55, and a support tensioner 57. The frame 30 remains in a fixed position, with the mandrel 50 supported by preferably two, but at least one bearing free to rotate within the frame.

Figure 3:
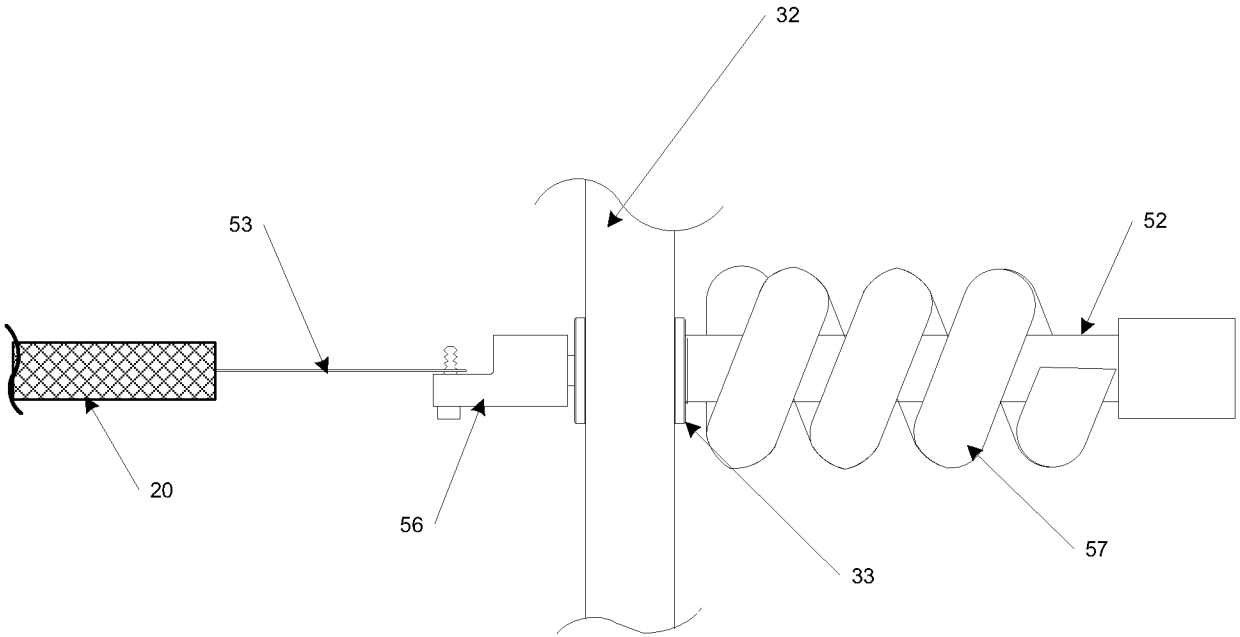
FIG. 3 is a detail elevational view of the mandrel end.

As is shown in FIGS. 2 and 3, in accordance with the present invention the frame has a first end 31 and a second end 32 with the mandrel 50 being largely positioned on the inside of the frame 30 between the first and second ends. The mandrel is supported by at least a first bearing 33 and preferably a second bearing 34 located at the first and second ends respectively. The mandrel 50 is provided with a stent support 53 consisting of a wire loop passing through the center of a stent 20. The stent 20 is gently but firmly supported on the stent support 53. Other embodiments of the stent support 53 might include a coil spring or ribbon.

In a preferred embodiment, the mandrel 50 is driven at its drive portion 54 by a rotary motor 70. The mandrel drive portion 54 may also be rotated by other means such as gears or a belt and pulley drive. The rotary motor 70, preferable directly coupled to the mandrel at the drive portion 54, may be automatically controlled to change speed and/or direction as well as to stop and/or start suddenly. This allows flexibility with respect to coating distribution over the exterior as well as interior of the stent 20, as sudden rotational changes may be used to intentionally shift the location of the stent 20 on the mandrel 50 which may improve coating distribution at the contact points between the stent 20 and the stent support 53 of the mandrel 50. A second rotary motor synchronized with rotary motor 70 may be used to provide a balanced rotational force to both ends of mandrel 50, thereby eliminating differential torque forces across the mandrel and/or stent as needed for optimum stent coating application.

The mandrel consists of a first shaft 51 and a second shaft 52 rotatably connected to the frame 30 through the bearings. As shown in FIG. 2, on the interior portion of the frame 30, a first support retainer 55 is attached to the distal end of the first shaft 51 and a second support retainer 56 is attached to the distal end of second shaft 52 within the interior portion of the frame 30. The stent support 53, which is a semi-rigid element, preferably a wire loop, attaches to each support retainer thereby spanning the opening between the first and second shaft. To achieve balanced centrifugal forces, the first and second shafts and the stent support generally share a common the longitudinal axis with the mandrel 50. During mandrel 50 rotation, the centrifugal forces produced in combination with the symmetrical geometry of the semi-rigid stent support 53 of the mandrel 50 allow for an inherent automatic centering of the stent 20 for coating, even if the stent 20 is initially placed off-center along the stent support 53.

The stent support 53 may be a wire loop made from a variety of materials. The wire may be electrically conducting or non-conducting depending on electrostatic properties of the stent 20 and the stent coating desired. For example, it may be desirable to manufacture the stent support 53 of the same material as used for the stent 20. In addition, if it is desirable to maintain a positive electrostatic charge on the stent 20 while applying a stent coating, a non-conducting polymer wire or coated metallic wire may be preferable to use. With other embodiments, it may be preferable to use, copper, nitinol or stainless steel wire. The stent support 53 is preferably a semi-rigid element for optimum utility. The preferred diameter of the stent support 53 wire loop is highly dependent on the characteristics of the stent to be coated.

For an embodiment wherein the first bearing 33 is driven and the second bearing 34 is not, especially during starting and stopping, rotational forces will be transmitted between the first and second bearings through the stent support 53 and the stent 20 itself. The stent support 53 must be of sufficient rigidity to withstand this torque without collapse of the stent support 53 or excessive deformation to the stent support 53 or stent 20. This factor tends to favor utilizing a stent support 53 with a larger wire diameter.

A countervailing consideration, tending to favor stent support 53 using smaller wire diameter is to minimize internal shadowing from the stent support 53 when coating stent interiors. The optimum stent support 53 will provide a balance between overcoming friction during start/stop operations and minimizing internal shadowing. Furthermore, if it is desirable to reuse a given stent support 53 multiple times, a shape memory alloy such as nitinol may provide advantages for use as a stent support 53 due to its ability to resist permanent deformation. As an alternative embodiment, the differential torque across the stent support 53 can also be minimized by providing a second drive portion and/or second rotary motor which allows greater flexibility when selecting wire diameter and material to be used for a stent support 53.

The preferred diameter of the stent support 53 wire loop is also dependent on the physical characteristics of the stent to be coated. A maximum diameter of the stent support 53 wire loop is generally less than the radius of the stent 20. This is preferred to prevent deformation of the stent 20 as it is installed and/or removed from the stent support 53. It is also desirable that the stent support 53 be easily threadable through the stent 20 without breaking through the relatively delicate and permeable wall of the stent 20. A minimum wire diameter selected as useable under the present invention would be large enough so that the support tensioner 57 wire loop stays in the interior of the stent 20 as it is threaded through the interior of the stent 20. Therefore, the wire used for stent support 53 should be compliant enough to hold the stent 20 without deforming it when stent support 53 is biased and expanded open by the support tensioner 57, which is preferably a spring, with the stent support 53 also being resilient enough to transfer torque of rotation. The preferred embodiment for the support tensioner 57 under the present invention is an enamel coated copper wire with a thickness between 32 to 36 gauge.

Figure 4:
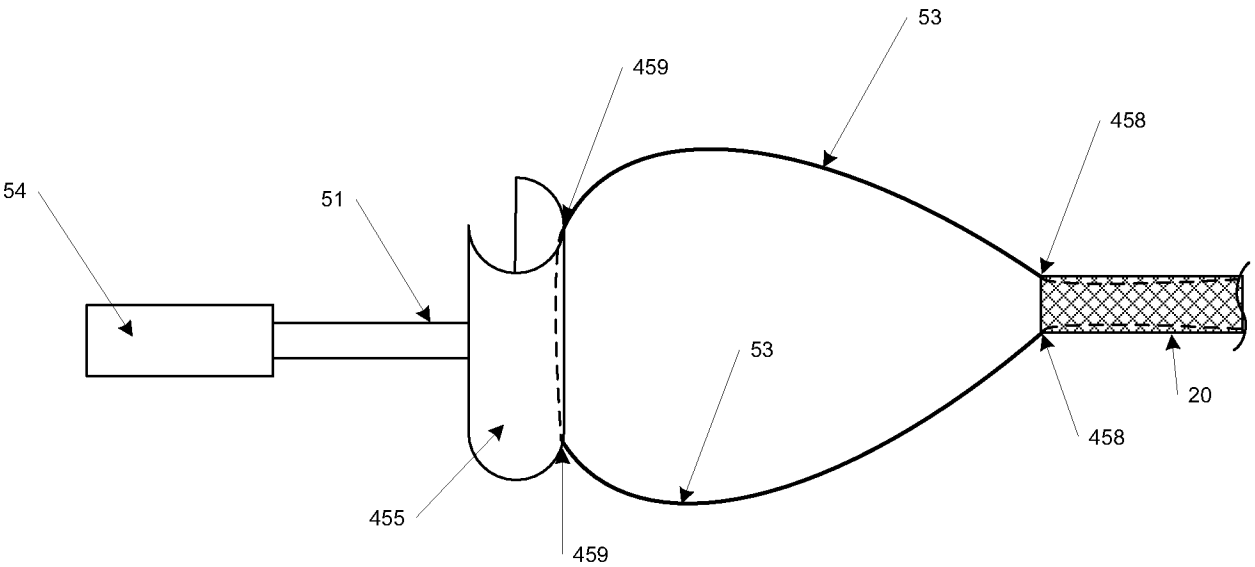
FIG. 4 is a detail plan view of an alternative embodiment of the mandrel end.
Figure 5:
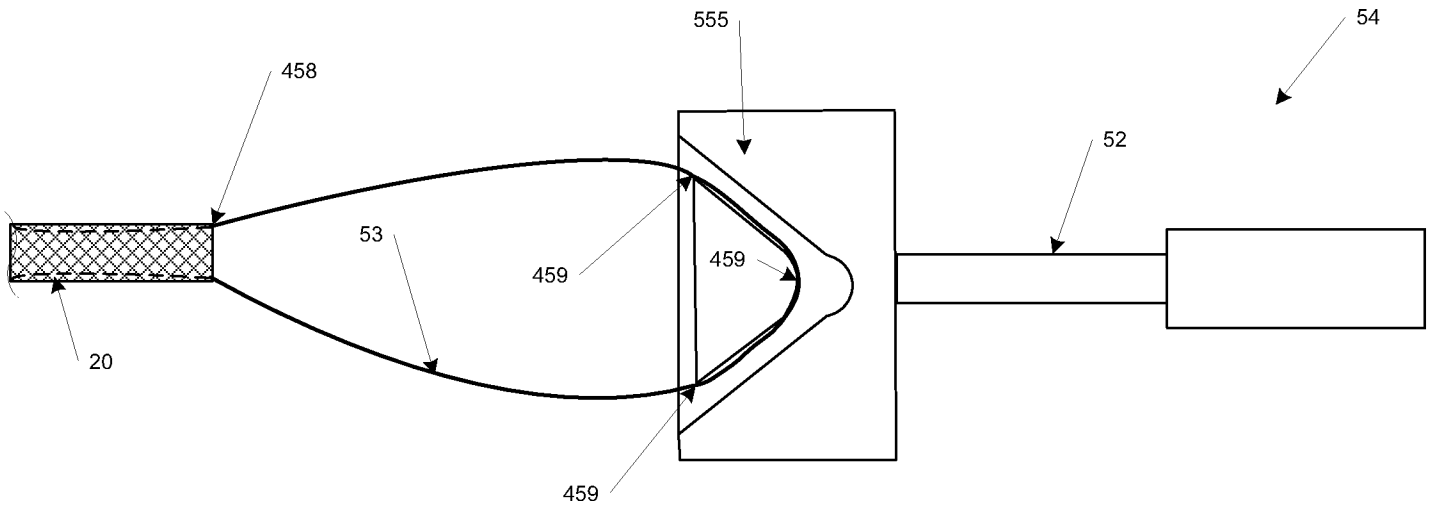
FIG. 5 is a detail plan view of an alternative embodiment of the mandrel end.
Figure 6:
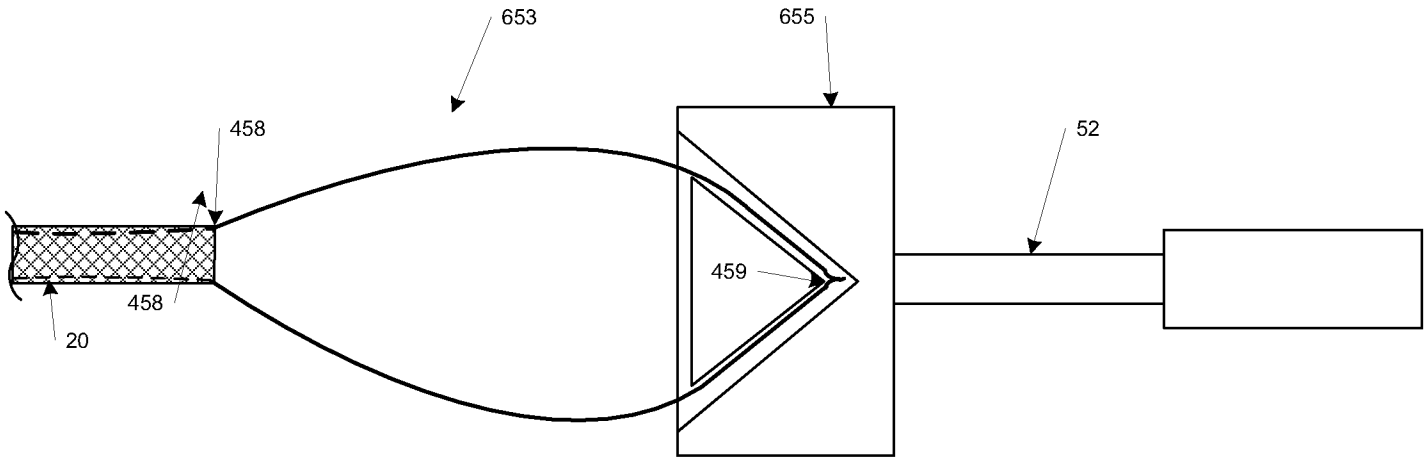
FIG. 6 is a detail plan view of an alternative embodiment of the mandrel end.

The stent support 53 is held at both ends by a first support retainer 55 and/or a second support retainer 56. The support retainer may be a device for attachment to a wire loop such as a hook, clasp or clamp. FIGS. 4, 5 and 6 show alternative embodiments of the support retainer. The support retainer must generally spread the stent support 53 to a width at least as wide as the inside diameter of the stent 20. The support retainers spread the wire loop apart sufficiently such that the loop engages the inside edge of the respective ends of the stent 20 at contact point(s) 458 as shown in FIGS. 4, 5 and 6. The first alternative support retainer 455 shown in FIG. 4 is an open tube shaped support retainer. In FIG. 5 a second alternative support retainer 555 shows a triangular shaped support retainer with a pointed leading attachment point 459. In FIG. 6 third alternative support retainer 655 shows a triangular shaped support retainer with a rounded leading attachment point 459. At least one support tensioner 57, such as a spring, simultaneously maintains sufficient tension on the stent support 53 to generate a relatively light force on the stent 20 to positively locate it between the support retainers 55 and 56. Due to the relatively light force from the stent support 53 within the stent 20, the stent support 53 does not apply damaging forces to the stent 20 which would stretch the stent 20 from the interior of the stent 20 at the contact point(s) 458. Moreover, due to the stent supports' flexibility, the stent support 53 and stent holders 10 can accommodate a range of stent lengths and diameters before a larger or smaller stent support 53 is needed. Furthermore, a variety of stent supports 53 can be used by the same stent holder 10 for greater versatility with a given stent holder 10.

Figure 7:
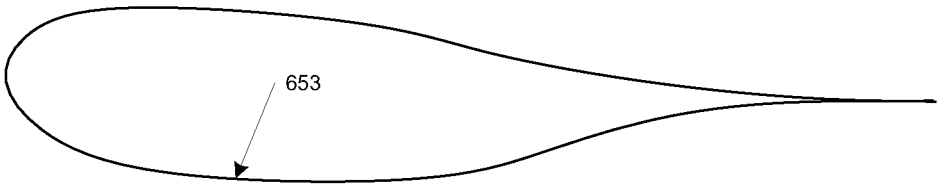
FIG. 7 is a detail plan view of an alternative embodiment of a stent support.

Under the preferred embodiment, the stent support 53 is reusable. In its wire loop embodiment, as the stent support 53 is installed through the stent 20, the lead edge is necessarily compressed or crimped to pass through the stent with the amount of crimping dependant on the inside diameter of the stent 20 and the diameter of the wire used for the stent support 53. A crimped portion of the stent support 53 could interfere with proper centering of stent 20 and other coating aspects of a rotating stent support 53 by creating an asymmetrical longitudinal axis with respect to the stent support 53. If a spring or resilient material is used for the support tensioner 57 the crimped portion will relax as the stent support 53 emerges from the stent 20 and is installed on the support retainer 55. As an alternative embodiment shown in FIG. 6, a crimped portion can be designed into the stent support as shown in FIG. 7 and aligned with a corresponding support retainer 655 so that the crimped stent support 653 remains symmetrical along its longitudinal axis.

Figure 8:
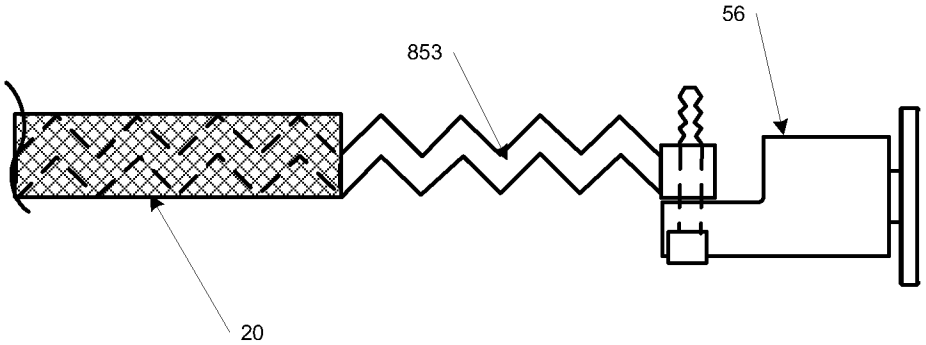
FIG. 8 is a detail plan view of an alternative embodiment of a stent support.

Although the preferred embodiment stent support is a wire loop, other non-loop embodiments such as a ribbon, spring, twisted or curved wire are possible. In FIG. 8 an alternative stent support 853 in the form of an expanded flat spring is shown.

Because the light holding force on the stent 20 can be easily released by biasing the support tensioner 57, installing and/or removing a stent 20 from the mandrel 50 for coating is fast and convenient without special tools or equipment required for disassembly.

The mandrel 50, supported by bearing surfaces 33 on the frame 30, rotates within the frame 30 exposing the stent 20 to the coating spray 91. Attached to the mandrel 50 is at least one drive portion 54 located preferably on the exterior portion of the frame on the first and/or second shaft. The coating feed 90 is typically pumped to the spray gun 80 often with a syringe pump. A spray gun 80, preferably using ultrasonic energy generates a coating spray 91 from a coating feed 90 solution. The coating spray 91, preferably a mist or aerosol can also be generated with a pressurized nozzle. The coating feed 90 consists of the coating material for the stent 20 usually dissolved or suspended within a carrier solvent. The ultrasonic spray gun 80 is driven by a linear motor 70 so that the relatively narrow band of coating spray 91 may deposit a uniform coating over the entire length of the stent 20. Except for the rotating mandrel 50 carrying the stent 20, the stent holder 10 is fixed relative to the spray gun. Therefore, the spray gun can be positioned so that the coating spray 91 has an unobstructed path to the rotating stent. Other than the rotating stent 20 that is being coated, there are no elements of the present invention that interfere with the coating spray path. The mandrel rotation is provided by a directly coupled motor or other drive source positioned beyond the coating spray path.

It should be appreciated that elements described with singular articles such as "a", "an", and/or "the" and/or otherwise described singularly may be used in plurality. It should also be appreciated that elements described in plurality may be used singularly.

Although specific embodiments of apparatuses and methods have been illustrated and described herein, it will be appreciated by those of ordinary skill in the art that any arrangement, combination, and/or sequence of that is calculated to achieve the same purpose may be substituted for the specific embodiments shown. It is to be understood that the above description is intended to be illustrative and not restrictive. Combinations of the above embodiments and other embodiments as well as combinations and sequences of the above methods and other methods of use will be apparent to individuals possessing skill in the art upon review of the present disclosure.

The scope of the claimed apparatus and methods should be determined with reference to the appended claims, along with the full scope of equivalents to which such claims are entitled.

What is claimed is:

1. An apparatus for holding a medical device while applying a coating spray without shadowing, comprising:

a frame supporting a first and second bearing;

a mandrel rotatably secured to the frame between the first and second bearing;

the mandrel having a loop stent support spread at all segments and a first and second shaft;

the first shaft and second shaft mounted along a common longitudinal axis with the mandrel;

a drive portion attached to the mandrel;

the stent support passing through the stent and holding the stent between the first and second shaft;

a support retainer releasably attaching to the stent support; and a support tensioner contacting the frame and the mandrel for biasing the stent support.

2. The apparatus of claim 1 further comprising a rotary motor being directly coupled to the drive portion for rotating the mandrel.

3. The apparatus of claim 2 further comprising a second drive portion attached to the second shaft.

4. The apparatus of claim 2 further comprising a spray gun for applying a coating feed to the stent.

5. The apparatus of claim 4 wherein the spray gun produces ultrasonic energy for applying the coating feed to the stent.

6. The apparatus of claim 1 wherein the stent support is a wire loop.

7. The apparatus of claim 6 wherein the wire loop has a crimped portion.

8. The apparatus of claim 1 wherein the stent support is a 32-gauge enamel coated copper wire loop.

9. The apparatus of claim 1 wherein the stent support is a nitinol wire.

10. The apparatus of claim 4 further comprising a linear motor for directing the coating feed along the stent.

* * * * *